US005344131A

United States Patent [19]

Lawrence

[11] Patent Number: 5,344,131

[45] Date of Patent: Sep. 6, 1994

[54] STAPLING SORTER WITH ROTATING SHEET JOGGER

[75] Inventor: Frederick J. Lawrence, Tustin, Calif.

[73] Assignee: Gradco (Japan) Ltd., Tokyo, Japan

[21] Appl. No.: 44,439

[22] Filed: Mar. 29, 1993

[51] Int. Cl.[5] ..... B42B 2/02; B65H 31/36; B65H 39/10

[52] U.S. Cl. ..... 270/53; 271/221; 271/293

[58] Field of Search ..... 271/221, 222, 293; 270/53

[56] References Cited

U.S. PATENT DOCUMENTS

| | | | |
|---|---|---|---|
| 1,448,301 | 3/1923 | Hotchkiss | 271/221 |
| 3,250,529 | 5/1966 | Eissfeldt et al. | 271/221 |
| 3,658,324 | 4/1972 | Snellman | 271/89 |
| 3,893,665 | 7/1975 | Greene | 271/221 |
| 3,910,568 | 10/1975 | Brown et al. | 271/221 |
| 3,949,982 | 4/1976 | Snellman et al. | 271/222 |
| 4,466,606 | 8/1984 | Snellman et al. | 271/222 |
| 4,667,809 | 5/1987 | Raybuck | 271/221 X |
| 5,044,625 | 9/1991 | Reid | 270/53 X |
| 5,098,074 | 3/1992 | Mandel et al. | 270/53 |
| 5,112,035 | 5/1992 | Yamamoto et al. | 270/53 |
| 5,125,634 | 6/1992 | Lawrence | 270/53 |

FOREIGN PATENT DOCUMENTS

| | | | |
|---|---|---|---|
| 185046 | 6/1906 | Fed. Rep. of Germany | 271/221 |
| 109359 | 6/1983 | Japan | 271/221 |
| 177251 | 10/1984 | Japan | 271/221 |
| 4-286693 | 10/1992 | Japan | 270/53 |

*Primary Examiner*—Edward K. Look
*Assistant Examiner*—John Ryznic
*Attorney, Agent, or Firm*—Newton H. Lee, Jr.

[57] ABSTRACT

A sorter of the moving bin type has a set of horizontally extended trays moved vertically between positions above and below a sheet entry location by cams which provide an enlarged entry space. A stapler is moved between a non-stapling position and a stapling position. The cams also enlarge the space between trays at the stapling position to permit a tray to be received in the throat of the stapler between stapler anvil and body.

A sheet aligning jogger has opposed jogging bars extending vertically at opposite sides of the trays and simultaneously moveable towards and away from one another to engage opposite sides of the sheets in the trays to align the side edges of the sets of sheets in a neat stack. The jogging bars are also rotated in opposite directions to apply a force to the sheets urging the trailing edge of the sheets opposite to the direction of feed into the trays against an alignment surface on the tray normal to the side edges for aligning the trailing edges of the sheets in the set.

11 Claims, 5 Drawing Sheets

STAPLING SORTER WITH ROTATING SHEET JOGGER

BACKGROUND OF THE INVENTION

The present invention relates to improved means for aligning the side and trailing edges of a set of sheets received in the trays of a sheet sorting or collating machine.

More particularly, the invention relates to such sheet set aligning means in a moving bin sorter which has automatic, in-bin finishing or stapling means for binding the sets of sheets received in the trays before removal of the sets of sheets from the trays.

In-bin stapling sorters as referred to are well known. As exemplified in U.S. Pat. Nos. 4,928,941 and 5,080,342, the sheets may be aligned against a registration surface provided by a standard or frame member or on a bin edge by means of a pusher which is actuated transversely to the direction of the feed of sheets into the trays. The trailing edges of the sheets are aligned by gravity against backstops at the low ends of the sorter trays.

As exemplified in U.S. Pat. No. 5,104,106, a jogger arm has a pusher at one side of the sorter trays to engage a side edge of the sheets and push the sheets towards a registration wall at the other side of the trays, but the arm swings in an arc producing a compound directional force to also bias the sheets towards the backstop at the lower ends of the trays, in an effort to register the sheet edges both laterally and longitudinally of the tray.

In both of the prior art examples of in-bin sorting machines referred to above, the sheets are moved, in each case, to one side of the trays. However, in U.S. Pat. No. 4,949,134, for example, there is disclosed a jogging mechanism which centers the sheets on the trays by movement of a pair of laterally spaced jogging rails towards one another. The rails are moved by racks and separate pinions. The sets of sheets are registered in the other direction by gravity at the low end of the trays.

A pair of opposed jogging rods which move towards one another in arched paths are known from U.S. Pat. No. 3,658,324.

Orbitally movable jogging rods are known from U.S. Pat. No. 3,910,568, wherein the rods laterally move the sheets against a spring loaded alignment bar opposed to the jogging rods. Also orbitally movable jogging rods are known from U.S. Pat. No. 3,250,529 for moving sheets or cards into an aligned set in a corner of a receptacle of a stapler.

These examples of prior art jogging or sheet set edge registering devices are not totally satisfactory or certain in their operation, particularly in the case that sheets have interfacial friction such as may be caused by static attraction between sheets or in the case that the sheets are fed into trays to form sets to be stapled in the trays.

In addition, in the case of in-bin stapling in moving bin sorters, it is necessary to provide for access of the stapler to the set of sheets to be finished. In the prior patent of Uto, et al U.S. Pat. No. 4,928,941, for example, there is disclosed a stapler which can swing to the stapling position in space provided by a combination of vertical space provided by the vertical displacement of the by the tray shifting means and horizontal space provided by horizontal displacement of the trays above the tray in which the stapling is performed. In this arrangement, the main body of the stapler is positioned in a large clearance above the end of the tray in which stapling is performed and the anvil against which the staple is crimped enters a small space between the tray in which stapling is performed and the next lower tray.

In Noto U.S. Pat. No., 4,361,393, Stemmle U.S. Pat. No. 4,687,191 and Cooper U.S. Pat. No. 4,681,310 there are disclosed in-bin stapling sorters of the moving tray type wherein, cams provide plural spaces between the trays for enlarging the sheet entry space between trays as well as for accommodating the body and the crimping anvil of the stapler as it moves into stapling position between the trays from the retracted or non-stapling position.

In Coombs U.S. patent application, Ser. No. 889,633, filed May 28, 1992 co-owned herewith, the jogging of sheets is performed as in the case of U.S. Pat. No. 4,928,941 in that the sheets are moved laterally relative to the direction of infeed into the trays as the trays are moved up and down by the tray shifting mechanism. In this sorter, the tray shifting mechanism does not provide any additional space to accommodate the stapler body, either between trays or longitudinally of the trays, but, instead, the stapler body engages and displaces the sets longitudinally as successive sets of sheets are being stapled in the bins.

SUMMARY OF THE INVENTION

The present invention provides improvements in sheet set registration in the trays of an in-bin stapling sorter, providing for neat in-bin stapling of aligned sets of sheets.

More particularly the invention relates to an in-bin stapling sorter of the moving bin type wherein the sheets are longitudinally and laterally registered in a position centralized in the tray in the direction of movement of the sheets into the trays.

In accomplishing the foregoing, jogger members are located at opposite sides of the trays and are simultaneously operable to be moved towards one another to laterally engage the sides of the sheets while being rotatable in opposite directions to apply to the sheets a light force to move the sheets in a direction at a right angle to the side edges towards a registration surface on the tray so that the sheets are edge aligned or registered in both a lateral and longitudinal direction as related to the movement of the sheets into the sorter trays.

While in registered condition, the sheets are stapled to provide neat finished sets of sheets, by stapling means which utilize, in combination, certain features of the above referred to prior art, including the opening of bins to provide space for the stapler, combined with set displacement during the stapling operations.

BRIEF DESCRIPTION OF THE DRAWINGS

FIG. 6 is a fragmentary detail in section, as taken on the line 6—6 of FIG. 5;

DESCRIPTION OF THE PREFERRED EMBODIMENT

Figure 1:
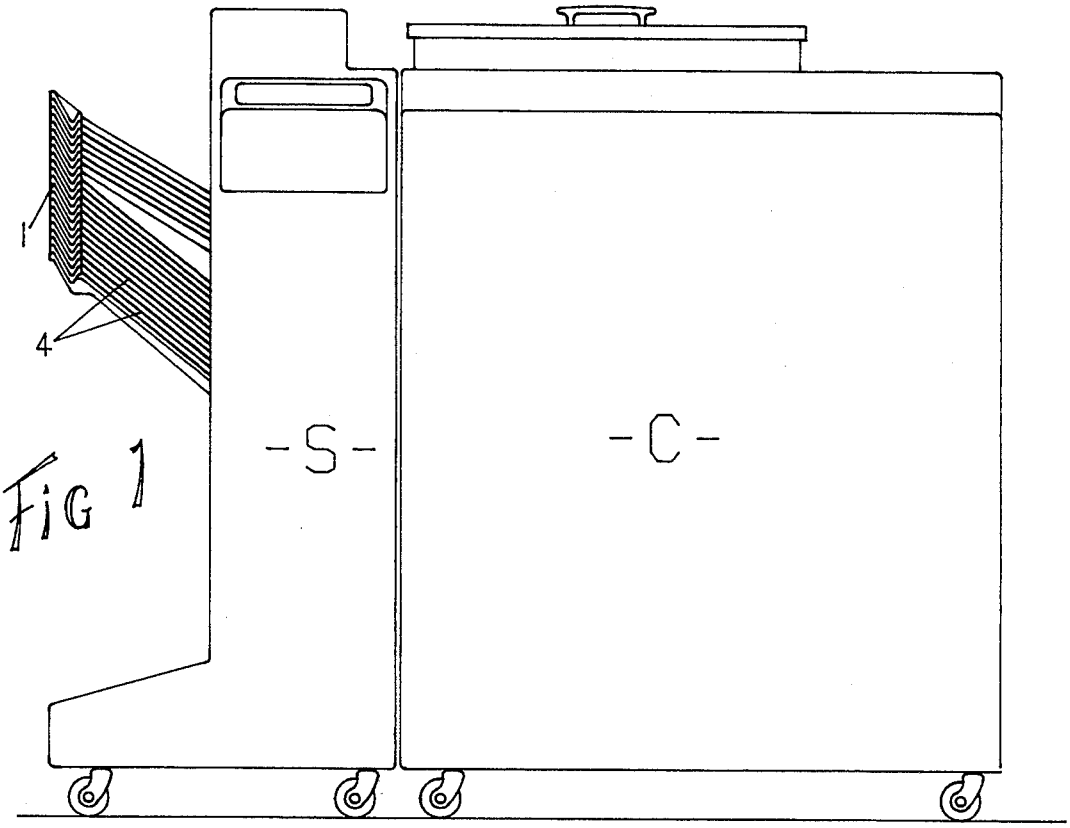
FIG. 1 is a side elevation showing the sorter of the invention in association with a host machine which supplies sheets to the sorter.
Figure 2:
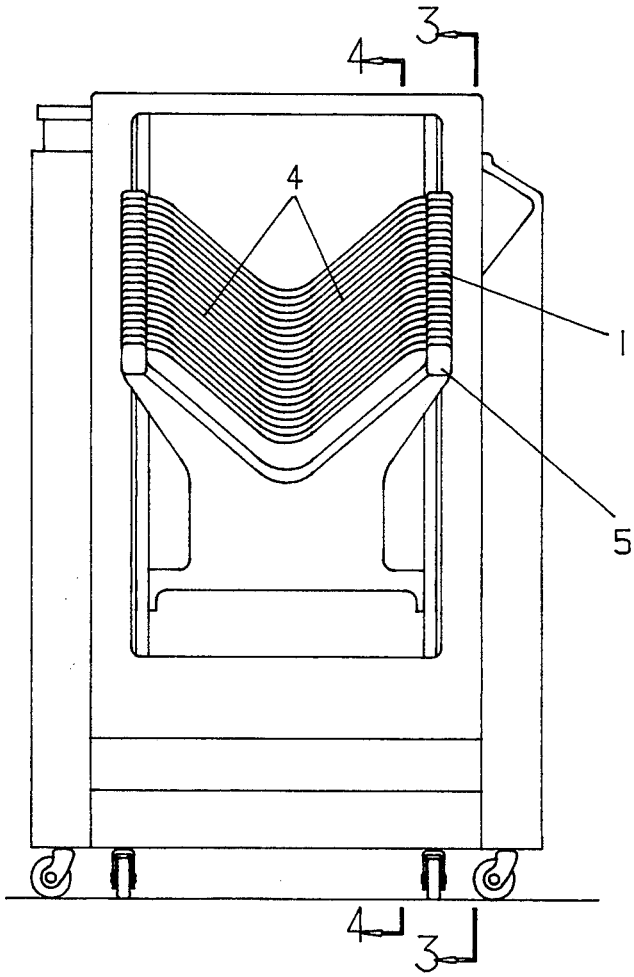
FIG. 2 is a left end elevation thereof.
Figure 3:
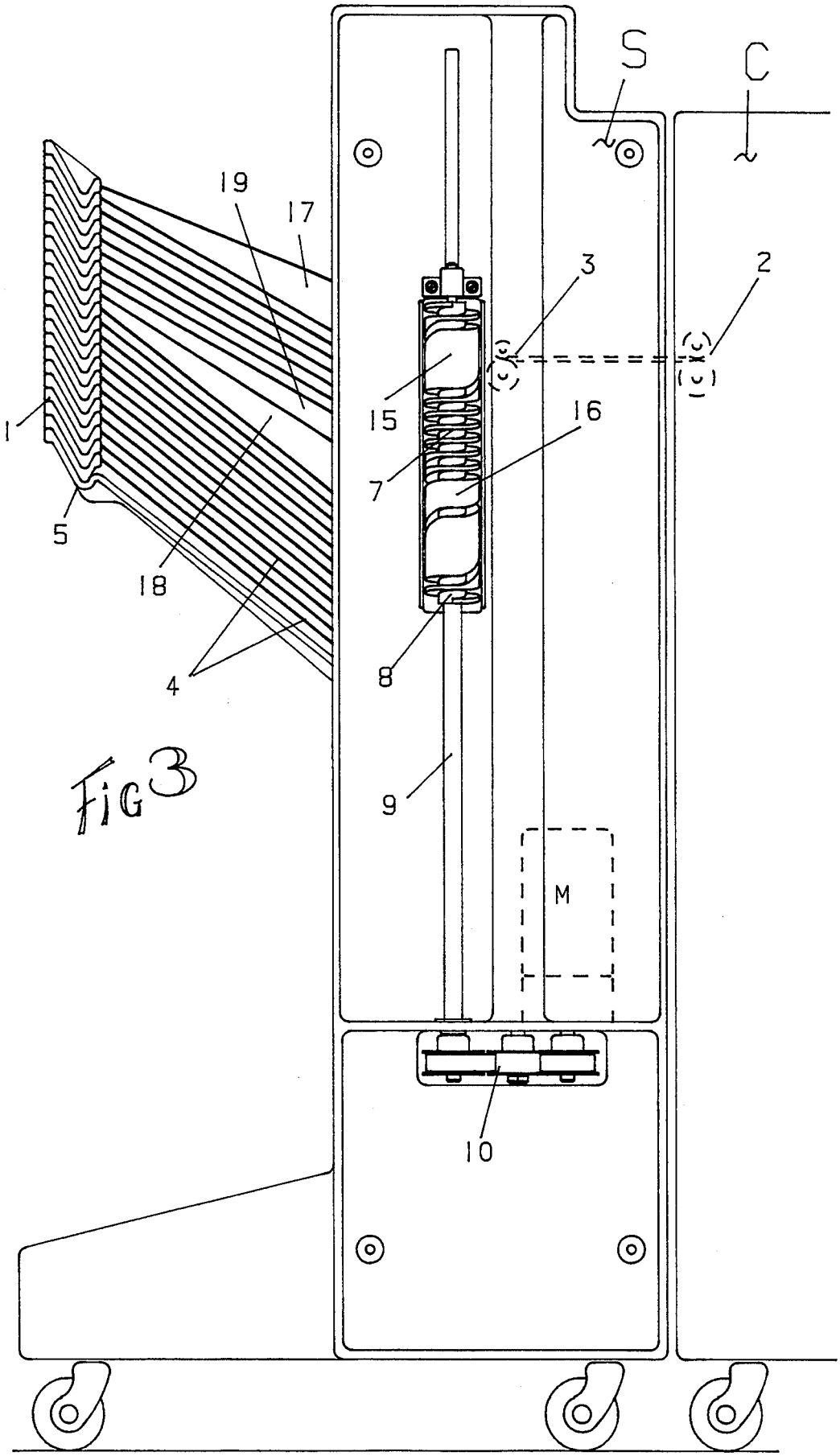
FIG. 3 is an enlarged vertical section on the line 3—3 of FIG. 2, showing the tray shifting mechanism.
Figure 4:
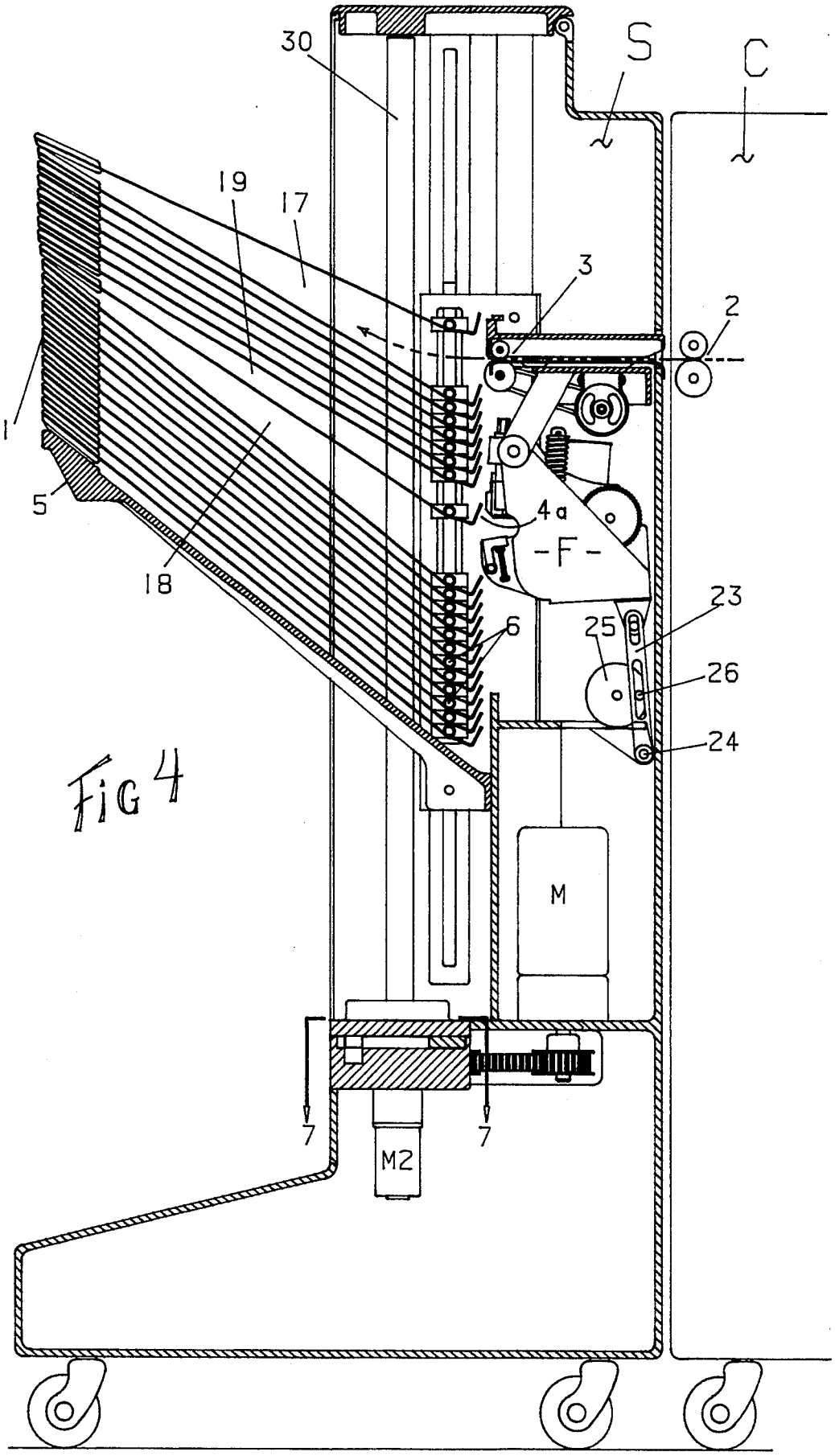
FIG. 4 is an enlarged vertical section on the line 4—4 of FIG. 2, showing the stapler in an inoperative position.

As seen in the drawings, referring first to FIGS. 1 through 4, the apparatus of the invention involves a sorter unit adapted to be associated with a sheet feeding host machine such as an office copier or printer C which will supply copies or sheets of printed material to the sorter serially for reception in a vertical stack of trays 1 from an output sheet feed 2 of the copier to the infeed rolls 3 of the sorter, as shown by the arrow in FIG. 4.

The tray stack 1 includes a plurality of generally horizontally extended trays 4 which are inclined upwardly from their sheet inlet ends towards the outer ends of the trays. At their outer ends, the trays are supported on a lower tray support 5. The inner ends of the trays have trunnions or cam followers projecting outwardly at opposite sides of the trays for engagement in cam tracks 7 in rotary cams 8 at opposite sides of the assembly. As seen in FIGS. 3 and 4, each cam 8 is supported on a shaft 9 adapted to be rotated by drive means 10 which includes a drive motor M, suitable gearing 11 and a drive for rotating the pair of shafts 9 in unison, as is well known.

The bottom support 5 extends outwardly from the sorter frame or housing structure to beneath the lowermost tray and is carried by a vertically extended frame 12 having lateral guide pins 13. The guide pins 13 and trunnions 6 are vertically shiftable in vertically extended guide slots 14 in the sorter housing structure, and the tray support 5, its frame 12 and the trays 4 all move vertically upon rotation of the cams 8, as the trunnions 6 ride in the cam tracks 7.

Figure 5:
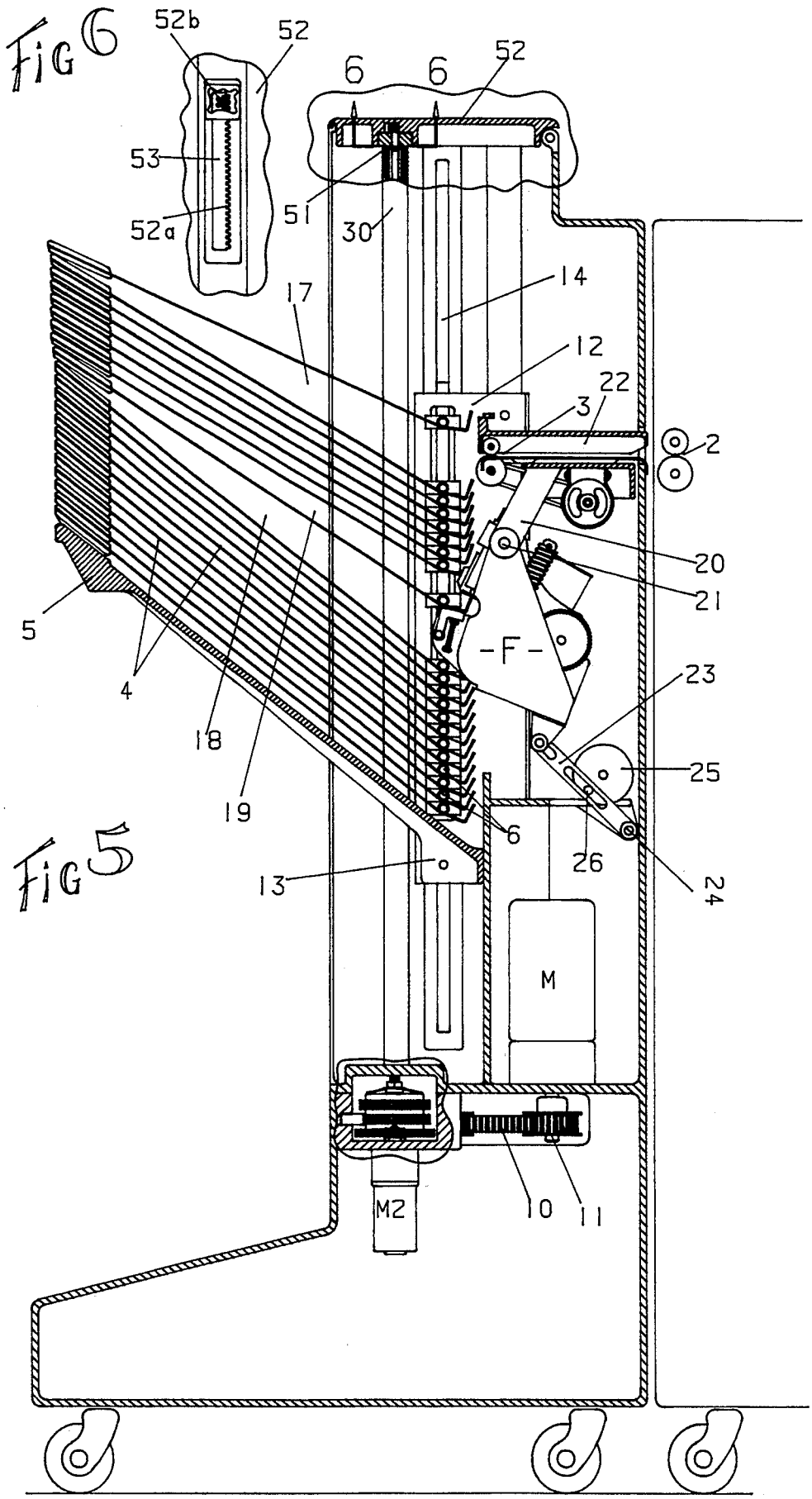
FIG. 5 is a view corresponding with FIG. 4, but with the stapler in stapling position and with fragmentary portions broken away to expose operating structures.

Such a sorter structure, as thus far described, is shown in my prior U.S. Pat. No. 4,911,424 and is well known in the art. Cams such as that designated 8 are known in the prior art from, for example, the U.S. Pat. No. 4,687,191 referred to above. The cams 8 are spiral cams having upper, lower and intermediate low pitch cam track sections 15 and 16, as seen in FIG. 5. The high pitch cam section 15 is adapted to provide between trays 4 an enlarged sheet entry space 17, while high pitch cam section 16 is adapted to provide a first enlarged space 18 between a pair of trays and an additional enlarged space 19 between the pair of trays next above the space 18. These spaces 18 and 19, as seen in FIG. 5 are adapted to provide access for the stapler or finisher F, so that the tray between spaces 18 and 19 has access to the throat of the stapler, allowing the set of sheets thereon to be stapled.

Referring to FIGS. 5 and 6, the stapler or finisher F is adapted to pivotally move between the non-stapling position of FIG. 4 and the stapling position of FIG. 5. The stapler F is pivotally mounted at 21 on a support 20 dependent from the frame 22 for the sheet infeed 2.

The stapler F is slidably connected to the end of a pivot link 23 which is pivoted at its other end at 24 on the frame. A crank 25 has a sliding connection at 26 with link 23, so that as the crank 23 rotates it will swing the stapler to the two positions for stapling (FIG. 5) or not (FIG. 4).

In accordance with the present invention, it is an object to provide jogging or set aligning means for effecting edge registration of the sheets of paper forming a set of sheets to be stapled. These means will be best understood upon reference to FIGS. 4, through 12.

Figure 8:
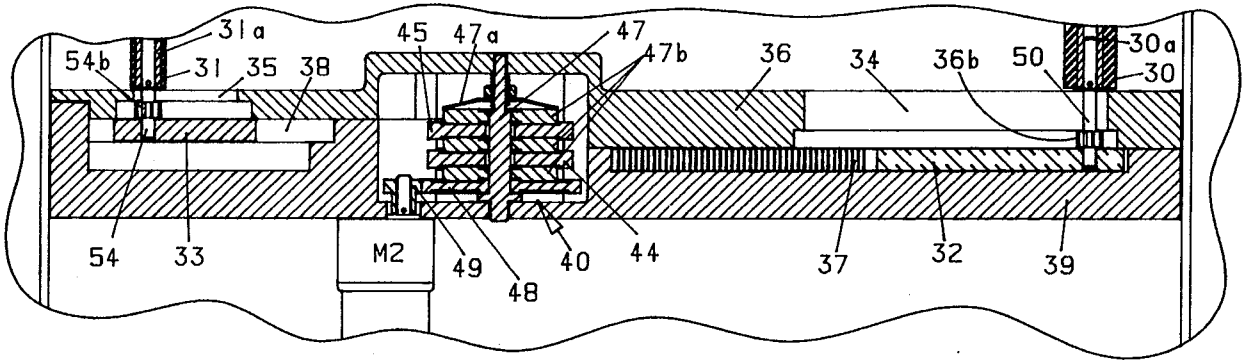
FIG. 8 is a vertical section on the line 8—8 of FIG. 7.
Figure 9:
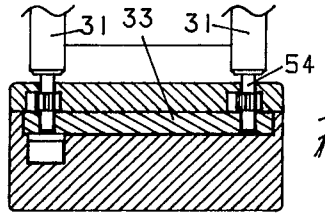
FIG. 9 is a vertical section on the line 9—9 of FIG. 7.
Figure 10:
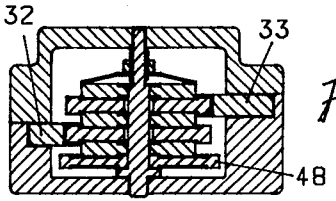
FIG. 10 is a vertical section on the line 10—10 of FIG. 7.

As seen in FIGS. 4, 5, 8 and 11, a jogging rod assembly 30 extends vertically at one side of the tray set 1. At the other side of the tray set is a pair of vertically extending jogging rod assemblies 31, as seen in FIGS. 8 and 9. As will be later described, the opposing jogging rods 30 and 31, are movable, in unison, towards and away from one another to engage the opposite side of sheets in the trays to align the side edges, while, at the same time the jogging rods are rotated on their vertical axes so that their peripheries move in opposite directions at the point of contact with the side edges of the sheets towards the low end or sheet inlet ends of the trays. This provides a friction force on the sheets urging them against a back wall 4*a* of the trays (see FIG. 4) for trailing edge alignment of the sheets against wall 4*a* so that the sets are aligned on their X-Y axes upon application of a staple.

Jogging rod 30, at its lower end, is connected to a horizontally extended slide plate 32 so as to move horizontally with the slide plate. Jogging rods 31 are connected at their lower ends to a slide plate 33 so as to move horizontally with this slide plate. The lower ends of the rods 30 and 31, respectively, extend through laterally extended, elongated slots 34 and 35 in a cover plate 36, and the slides are movable in cavities 37 and 38, respectively formed in a base plate 39 of the jogging rod operating means 40.

Slides 32 and 33 have oppositely facing racks 42 and 43, respectively, engageable with pinions 44 and 45 (see FIG. 8) of a pinion assembly 46 rotatably supported between the cover 36 and base 39 on a drive shaft 47. A lower driven gear 48 on shaft 47 is adapted to be driven in opposite directions by the drive pinion 49 on the output shaft of a reversible motor M2. Therefore, reverse operation of motor M2 will rotate pinions 44 and 45 oppositely, accordingly reciprocating slides 32 and 33 oppositely. Such opposite movements of slides 32 and 33 reciprocates the jogger rods 30 and 31 towards and away from one another, to effect side edge alignment of the sheet sets. Such reciprocation of the rods is adapted to jog or align sheets of different widths.

Figure 7:
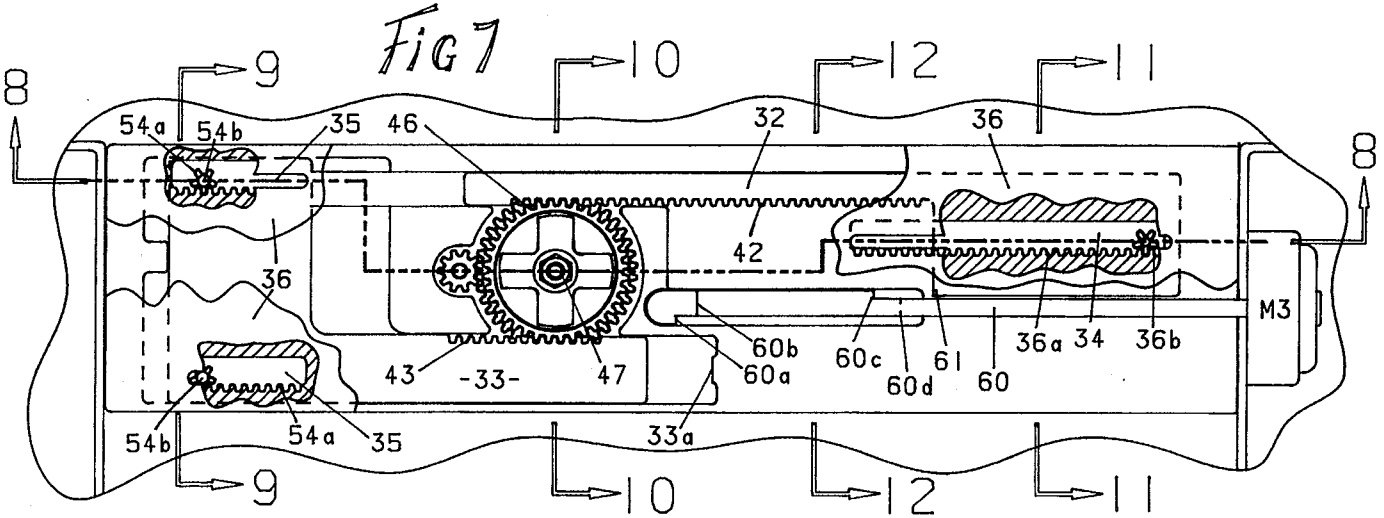
FIG. 7 is a fragmentary horizontal section, on the line 7—7 of FIG. 4.
Figure 11:
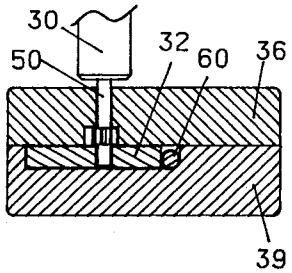
FIG. 11 is a vertical section on the line 11—11 of FIG. 7.
Figure 12:
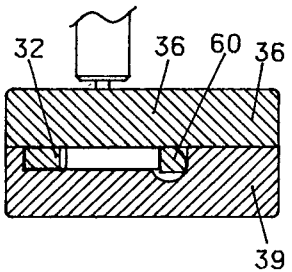
FIG. 12 is a vertical section on the line 12—12 of FIG. 7.

As seen in FIGS. 7, 11 and 12 an elongated rod 60 is rotatably disposed between the base plate 39 and cover plate 36. The rod 60 has at four separate positions, stop shoulders 60*a*, 60*b*, 60*c* and 60*d* adapted to be selectively oriented by a stepper motor M3 to position one of the stops for engagement by a stop shoulder 61 on the slide 32. Accordingly, the extent to which slide 32 can move in a left hand direction, as seen in FIG. 7, depends upon which of the stops 60*a*, 60*b*, 60*c* or 60*d* is oriented in confronting relation to the stop 61. As seen in FIG. 7, the inner end of slide 33 is confronted by a stop 33*a* which limits movement of slide 33 to the right a fixed distance. Since slide 32 moves to the left a selected distance determined by the stop shoulders 60*a*, 60*b*, 60*c* and 60*d*, the ultimate relative movement of the jogger rods 30 and 31 towards one another is determined by the spacing between stop 33*a* and the selected stop 60*a*, 60*b*, 60*c* or 60*d*, which is selected depending upon the width of the paper of different sizes.

In order to allow the motion of the slides 32 or 33 to be stopped, for jogging sheets of different widths, the drive gears 44 and 45 are allowed to be stopped by the construction of the drive mechanism 40. Referring to FIG. 8, the drive mechanism is seen to be a slip-clutch mechanism in which a spring 47*a* loads the gears 44 and 45 between clutch discs 47*b*. With such a construction, depending upon the width of the paper and the selected one of the stops 60*a*, 60*b*, 60*c* and 60*d*, one of the slides may continue to move towards its stop after the other slide has been stopped.

Reciprocation of the slides 32 and 33 also effects opposite rotation of the jogging rods. For such purposes, referring to FIG. 8, the jogger rod assembly 30 includes a pin 50 at its lower end extending through cover slot 34 and rotatably connected to slide 32. The pin 50 extends into the lower end of rod assembly 30 which includes a tubular core on which is an elastomeric cover 30*a* for enhanced frictional contact with the side edges of the sheets. Referring to FIGS. 5 and 6, the upper end of rod assembly 30 has a pin 51 slidably supported in the top housing cover 52 and extending into a horizontal slot 53. The lower cover 36 and the top cover 52 have rack teeth 36*a* (see FIG. 7) and 52*a* (see FIG. 6), respectively, engaged by pinions 36*b* and 52*b*, so that as the slide 32 is shifted inwardly and outwardly, the rod assembly 30 is rotated in opposite directions.

Correspondingly, the jogger rod assemblies 31 have pins 54 at their lower ends, as best seen in FIGS. 8 and 9, connected to slide 33 for movement of rods 31 towards and away from rod 30. Also, the lower cover 36 has rack teeth 54*a* engaged by pinions 54*b* on pins 54 to rotate the rods 31 as the slide 33 is reciprocated, so that the elastomeric covers 31*a* of rods 31 frictionally engage the side edges of the sheets in opposition to the rod 30, as the rods 30 and 31 are rotated in opposite directions to move the sheets towards the rear wall 4*a* of the trays.

OPERATION

Suitable control means well known in the art are employed for operating the apparatus to sort or collate sets of sheets, and staple the sheets in the trays following the sorting or collating operations.

Sheets of printed material are fed from the copier or printer C to the sheet infeed 3, while the stapler F is in the non-stapling position of FIG. 4. Following entry of one or more sheets into a tray, depending upon whether the apparatus is being employed to receive successive copies of sheets in successive trays to form sets or whether the apparatus is being employed to collect complete document sets in successive bins, the control means actuates motor M to drive the cam shaft 9 for one revolution. This shifts the trays upwardly or downwardly depending upon the direction of rotation to provide the enlarged sheet receiving space 17 between adjacent trays held spaced by the cam section 15 until the desired number of sheets are fed to the next and then successive trays.

After sheets have been supplied to the desired number of bins, motor M2 is operated to activate the jogging drive motor, first in a direction and for a distance to engage between the jogging rods 30 and 31 the sheets of a given size to align the opposite sides of the sheets, as the rods oppositely rotate to frictionally move the sheet counter to the infeed direction into engagement with the lower ends 4*a* of the trays, and, second, in the opposite direction, to retract the jogging rods to their positions of FIGS. 7 and 8 to allow freedom of movement of succeeding sheets into the trays.

Following feeding of the selected number of sheets into the trays to form a selected number of sets, the stapling function is initiated. The lowermost tray which contains a set of sheets to be stapled is positioned at the stapling position shown in FIGS. 4 and 5 by the drive motor M. The control system then activates the stapler swinging means to move the stapler to the stapling position of FIG. 5 from the non-stapling position of FIG. 4, as permitted by the increased spaces 18 and 19 between the trays. While the stapler is in the stapling position, it is activated to drive a staple into the aligned edge of the set of sheets, and then the stapler is retracted to the position of FIG. 4. At this time, motor M is again activated to shift the trays downwardly until the next tray above is in the stapling position. These functions are repeated for successive stapling of the sets of sheets in the trays.

From the foregoing, it will be understood that each set of sheets is neatly aligned at its edges when the staple is applied to provide neat finished sets, due to the compound jogging action between the opposed jogging rods as they move towards the side edges of the sheets to provide side edge alignment and rotate in opposite directions to frictionally drive the sheets against the rear wall of the trays.

I claim:

1. In a sorting apparatus for receiving successive sheets from a copy producing machine, comprising tray means including at least one tray for receiving sheets, jogging means for aligning the edges of sheets in said tray means in two directions, the improvement wherein said jogging means includes opposed jogging rods moveable towards and away from one another to engage and align opposite sides of sheets therebetween, means for moving said rods towards and away from one another, means for rotating said rods in opposite directions responsive to said movement of said rods to frictionally engage said sides of said sheets to move the sheets at a right angle to the movement of said rods, and an alignment surface on said tray engageable by said sheets upon movement of said sheets at said right angle, said means for moving said rods towards and away from one another including a pair of horizontally movable slides, said rods being connected to said slides, and means for simultaneously moving said slides horizontally in opposite directions, said slides and said rods having rack and pinion means for simultaneously rotating said rods as aforesaid.

2. In a sorting apparatus for receiving successive sheets from a copy producing machine, comprising tray means including at least one tray for receiving sheets, jogging means for aligning the edges of sheets in said tray means in two directions, the improvement wherein said jogging means includes opposed jogging rods moveable towards and away from one another to engage and align opposite sides of sheets therebetween, means for moving said rods towards and away from one another, means for rotating said rods in opposite directions responsive to said movement of said rods to frictionally engage said sides of said sheets to move the sheets at a right angle to the movement of said rods, and an alignment surface on said tray engageable by said sheets upon movement of said sheets at said right angle, said means for moving said rods towards and away from one another including a pair of horizontally movable slides, said rods being connected to said slides, and means for simultaneously moving said slides horizontally in opposite directions, including drive means for moving said rods, as aforesaid, wherein said drive means permits continued horizontal movement of one said slides following stopping of horizontal movement of the other of said slides, and including means for selectively stopping horizontal movement of said other of said slides in the sheet aligning direction.

3. Sorting apparatus as defined in claim 2, said drive means including slip-clutch means and gears driven by the slip-clutch means to move the respective slides.

4. Sorting apparatus as defined in claim 2, including a fixed stop for stopping movement of one of said slides and a plurality of selective stops for stopping movement of the other of said slides, and means for selecting one of the selective stops to said other of the slides, the distance between the fixed stop and the respective selective stops causing positioning of said rods for jogging sheets of different widths.

5. In a sorting apparatus for receiving successive sheets from a copy producing machine, comprising tray means including at least one tray for receiving sheets, jogging means for aligning the edges of sheets in said tray means in two directions, the improvement wherein said jogging means includes opposed jogging rods moveable towards and away from one another to engage and align opposite sides of sheets therebetween, means for moving said rods towards and away from one another, means for rotating said rods in opposite directions responsive to said movement of said rods to frictionally engage said sides of said sheets to move the sheets at a right angle to the movement of said rods, and an alignment surface on said tray engageable by said sheets upon movement of said sheets at said right angle, said means for moving said rods towards and away from one another including a pair of horizontally movable slides, said rods being connected to said slides, and means for simultaneously moving said slides horizontally in opposite directions, said means for rotating said rods including means operated in response to movement of said slides in opposite directions.

6. Sorting apparatus as defined in claim 5, said means for rotating said rods including pinions on said rods and a support structure having racks engaged with said pinion.

7. Sorting apparatus as defined in claim 1, including stapling means adjacent to said tray means movable from a non-stapling position to a position for stapling sets of sheets in said tray, and means for moving said stapling means between stapling and non-stapling positions when said jogging means have jogged the sheets in said tray.

8. Sorting apparatus as defined in claim 7, said tray means including a stack of vertically spaced trays moveable to provide a sheet entry space and an additional space between trays, said stapling means being movable to said stapling position relative to said trays in said additional space from said non-stapling position, and including means for successively moving said trays to provide said sheet entry space and said additional space.

9. Sorting apparatus as defined in claim 8, wherein the means for moving said trays includes high and low pitch cams at opposite sides of said trays having a first high pitch cam to provide said enlarged sheet receiving space and a second high pitch cam to provide said additional space.

10. Sorting apparatus as defined in claim 8, including a horizontal pivot support for said stapling means at the sheet inlet ends of said trays for pivotal movement of said stapling means between said stapling and non-stapling positions.

11. In a sorting apparatus for receiving successive sheets from a copy producing machine, comprising tray means for receiving sheets, jogging means for aligning the side edges of sheets in said trays, means for vertically moving the trays past a sheet entry location, and a stapler for stapling the sheets in said trays, the improvement wherein said stapler is pivotally mounted between the sides of said trays on a horizontal axis for swinging to a stapling position from a non-stapling position at the sheet inlet ends of said trays, and means for driving said stapler between said positions, said means for driving said stapler including a link slidably and pivotally connected to said stapler at one end, means mounting the other and of said link on a fixed pivot, a crank slidably engaging said link between its ends, and a drive motor for said crank.

* * * * *